US008263305B2

(12) United States Patent
Ikami et al.

(10) Patent No.: US 8,263,305 B2
(45) Date of Patent: Sep. 11, 2012

(54) METHOD FOR PRODUCING TONER

(75) Inventors: Jun Ikami, Nagoya (JP); Masateru Kawamura, Toyoake (JP); Yasutomo Imai, Toyota (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 166 days.

(21) Appl. No.: 12/750,077

(22) Filed: Mar. 30, 2010

(65) Prior Publication Data

US 2010/0248115 A1 Sep. 30, 2010

(30) Foreign Application Priority Data

Mar. 31, 2009 (JP) ..... 2009-086865

(51) Int. Cl.
*G03G 9/00* (2006.01)

(52) U.S. Cl. ..... 430/137.14; 430/137.1

(58) Field of Classification Search ..... 430/137.1, 430/137.14
See application file for complete search history.

(56) References Cited

U.S. PATENT DOCUMENTS

| | | | | |
|---|---|---|---|---|
| 2005/0048392 | A1* | 3/2005 | Tanaka | 430/137.14 |
| 2006/0183047 | A1 | 8/2006 | Ikami et al. | |
| 2008/0286674 | A1* | 11/2008 | Kawamura et al. | 430/105 |

FOREIGN PATENT DOCUMENTS

| | | |
|---|---|---|
| JP | 08-220809 | 8/1996 |
| JP | 2006-227211 | 8/2006 |
| JP | 2007-058137 | 3/2007 |
| JP | 2008-286944 | 11/2008 |

* cited by examiner

*Primary Examiner* — Mark F Huff
*Assistant Examiner* — Stewart Fraser
(74) *Attorney, Agent, or Firm* — Banner & Witcoff, Ltd.

(57) ABSTRACT

Provided is a method for producing a toner having excellent particle size distribution and storage stability. The method set forth in the present specification is a method for producing a toner by aggregating and fusing base microparticles whose main component is a binder resin including anionic groups, wherein an aggregate is produced by aggregating the base microparticles in a base microparticle suspension, in a presence of a non-ionic surfactant such that a surface tension of an aqueous solution thereof is not lower than 45 mN/m at any concentration at or above a critical micelle concentration, and the toner is produced through fusion of the aggregate. According to this method, drops in a glass transition temperature of the toner can be curbed, and the toner having excellent storage stability and good particle size distribution can be obtained.

7 Claims, 3 Drawing Sheets

| | Surfactant type | Surfactant concentration (wt%) | Surface tension, measured in-house (mN/m) | Volume average particle size Dv (μm) | Degree of dispersion Dv/Dn | Degree of Tg drop | ΔT (°C) | Strage stability | Degree of agglomeration | |
|---|---|---|---|---|---|---|---|---|---|---|
| | | | | | | | | | Before storage | After storage |
| Toner 1 | Epan 485 | 0.2 | 53.8 | 7.1 | 1.17 | O | 0.1 | O | 8.8 | 10.4 |
| Toner 2 | Epan 680 | 0.2 | 53.5 | 7.2 | 1.16 | O | 0.1 | O | 8.9 | 10.1 |
| Toner 3 | Epan 785 | 0.2 | 47.2 | 7.2 | 1.17 | O | 0.5 | O | 9.4 | 10.7 |
| Toner 4 | Noigen SD300 | 0.2 | 48.2 | 6.9 | 1.18 | O | 1.5 | O | 8.5 | 11.1 |
| Toner 5 | Noigen EA167 | 0.2 | 46.1 | 7 | 1.19 | O | 1.9 | O | 8.9 | 12.4 |
| Toner 6 | Epan 485 | 0.3 | 53.8 | 7 | 1.15 | O | 0.2 | O | 9.2 | 10.5 |
| Toner 7 | Epan 485 | 0.1 | 53.8 | 7.5 | 1.2 | O | 0 | O | 8.8 | 10.3 |
| Comp. ex 1 | Noigen TDX120D | 0.2 | 31.2 | 7.5 | 1.18 | × | 5 | × | 9.9 | 39 |
| Comp. ex 2 | Noigen XL100 | 0.2 | 27.5 | 7.4 | 1.16 | × | 5.4 | × | 8.9 | 61 |
| Comp. ex 3 | Noigen SD80 | 0.2 | 27.5 | 7.2 | 1.18 | × | 6.5 | × | 9.5 | 57 |
| Comp. ex 4 | DKS NL250 | 0.2 | 42.1 | 7.4 | 1.21 | × | 5 | × | 8.7 | 37 |

Fig.2

METHOD FOR PRODUCING TONER

CROSS-REFERENCE TO RELATED APPLICATIONS

This application claims priority to Japanese Patent Application No. 2009-086865, filed on Mar. 31, 2009, the contents of which are hereby incorporated by reference into the present application.

TECHNICAL FIELD

The present teaching relates to a method for producing a toner.

DESCRIPTION OF RELATED ART

In electrophotographic or electrostatic recording image forming apparatuses, images can be formed on paper by fixing a toner to an image-forming portion. The toner comprises herein a binder resin and a colorant as main components and is charged with a predetermined polarity and to a predetermined amount of charge. Known such methods for producing toner include emulsification aggregation methods, in which base microparticles of submicron size are aggregated to a desired toner particle size, to form base particles that are then fused by heating to yield toner base particles.

Japanese Patent Application Publication Nos. 2006-227211 and 2008-286944, for instance, disclose the feature of using a polyester resin as the binder resin, and of exploiting self-dispersibility through neutralization of anionic groups, such as terminal carboxyl groups. Aforementioned prior art indicate that using the binder resin including the anionic groups allows avoiding the use of a surfactant, or reducing the amount of surfactant used, during production of the base particles through aggregation and fusion of the base microparticles. This allows, as a result, solving problems that are derived from the addition of the surfactant.

SUMMARY

However, the particle size distribution of toner tends to be poorer when no surfactants are used. On the other hand, it has been found that storage stability of the toner is impaired when surfactants are used.

Accordingly, it is an object of the present teachings to provide a toner having excellent particle size distribution and storage stability, and a method for producing such a toner.

As a result of research on the issue of the impaired storage stability of toner produced through emulsification aggregation, the inventors discovered an occurrence of unintended drops in the glass transition temperature (Tg) of toner. The inventors studied the phenomenon of the Tg drop, and found that a toner having good particle size distribution and storage stability can be obtained by curbing the drop in Tg, by selecting and exploiting the characteristics of the surfactant that is used during production on aggregate through aggregation of base microparticles.

The present teachings provide a method for producing a toner by aggregating and fusing base microparticles whose main component is a binder resin including an anionic group. The production method of the present teachings comprises the steps of: (a) preparing a suspension of the base microparticles; (b) producing an aggregate by aggregating the base microparticles in the base microparticle suspension, in the presence of a non-ionic surfactant such that a surface tension of an aqueous solution thereof is not lower than 45 mN/m at any concentration at or above the critical micelle concentration; (c) producing base particles by fusing the base microparticles in the aggregate; and (d) producing a toner using the base particles.

The present teachings provide a toner that is obtained by aggregating and fusing base microparticles whose main component is a binder resin including anionic groups, the toner comprising a core having a base particle resulting from aggregating and fusing the base microparticles using a non-ionic surfactant such that the surface tension of an aqueous solution thereof is not lower than 45 mN/m at any concentration at or above the critical micelle concentration.

BRIEF DESCRIPTION OF DRAWINGS

FIG. 2 is a table summarizing the evaluation results of toners and of non-ionic surfactants used in toners produced in examples.

DETAILED DESCRIPTION OF THE PREFERRED EMBODIMENT

Figure 1:
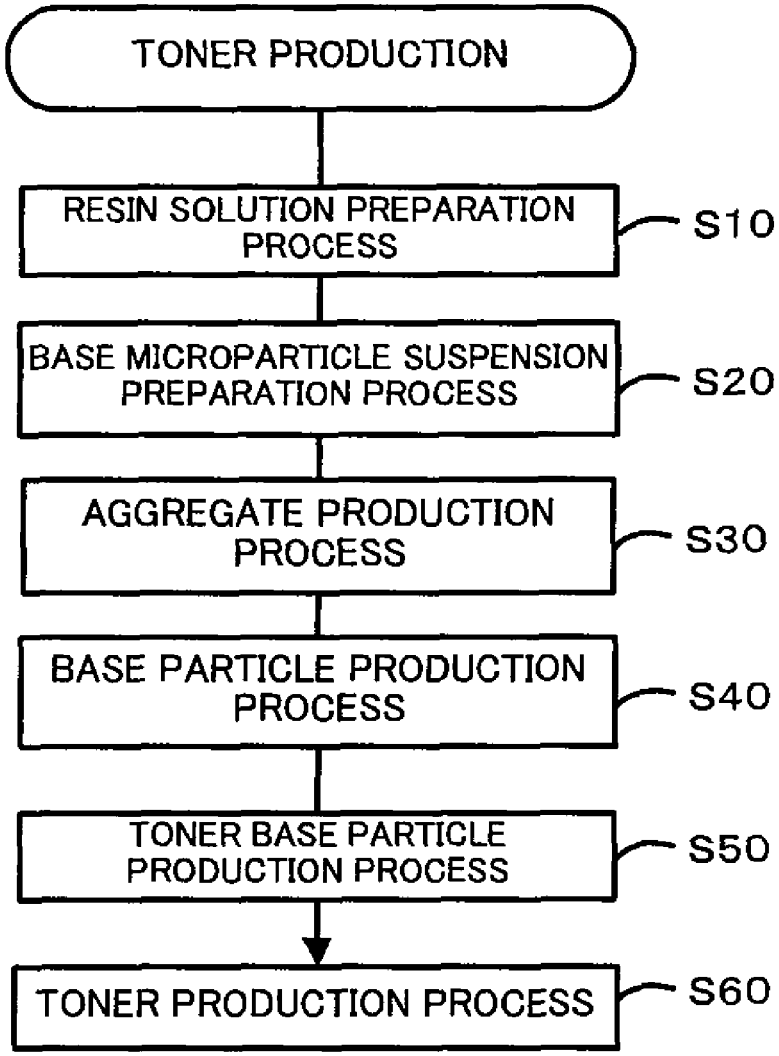
FIG. 1 is flow chart illustrating an example of a method for producing a toner.

The present teachings relate to a method for producing a toner by emulsification aggregation, and to a toner. In a production process of an aggregate of base microparticles in the method for producing the toner of the present teachings, where the toner is produced by aggregating and fusing the base microparticles whose main component is a binder resin including anionic groups, the aggregate is produced by aggregating the base microparticles in a base microparticle suspension, in a presence of a non-ionic surfactant such that a surface tension of an aqueous solution thereof is not lower than 45 mN/m at any concentration at or above a critical micelle concentration. This makes it possible to curb drops in a glass transition temperature (Tg) of the base particles and the toner, and obtain as a result a toner having excellent storage stability. Base particles having a size close to that of the toner are obtained through the aggregation of the base microparticles using the surfactant. Base particles having a good particle size distribution can be obtained as a result, which in turn allows obtaining a toner having a good particle size distribution.

The method for producing a toner of the present teachings uses the binder resin including the anionic groups. This allows reducing the amount of the surfactant used in the aggregate production process. Specifically, the self-dispersibility of the binder resin is exploited through the formation of a salt structure that results from neutralizing the anionic groups of such a binder resin. This allows, as a result, stabilizing the dispersion state of the binder resin or the aggregate thereof, while avoiding or curbing the use of surfactants and/or polymeric dispersants. Problems derived from residual surfactant or the like can be prevented thereby.

In the method for producing the toner of the present teachings, preferably, the step of preparing the suspension of the base microparticles is a step of emulsifying an organic solvent solution of the binder resin in a presence of an aqueous solvent, and evaporating thereafter the organic solvent to yield a suspension of the base microparticles. Preferably, the aforesaid step is a step of preparing the suspension of the base microparticles by dispersing the base microparticles through neutralization of at least some of the anionic groups. In this aspect, preferably, the aforesaid step is a step of preparing the suspension of the base microparticles without using a surfactant.

Preferably, the non-ionic surfactant is used in a concentration ranging from 0.1 wt % to 0.3 wt % in the step of producing the aggregate. In the method for producing a toner of the present teachings, preferably, the binder resin is a polyester resin.

Embodiments of the present teachings will be explained in detail below with reference to accompanying drawings. The explanation below will set forth first the various materials (toner constituent materials) that are used in the method for producing the toner of the present teachings, followed by a description of the production process of the toner according to the present teachings.

In the description hereinbelow, the term "base microparticles" denotes microparticles that result from at least microemulsifying, in an aqueous medium, a resin solution comprising a binder resin of the toner. The term "resin solution" denotes a solution comprising at least the binder resin of the toner, and optionally a colorant and a release agent, dissolved or dispersed in an organic solvent. The term "aqueous medium" denotes a medium, comprising mainly water, used during the emulsification of the resin solution. The aqueous medium may contain a dispersion stabilizer. As used herein, the term "aggregate" denotes the result of aggregating unaggregated base microparticles. The term "base particles" denotes the result of fusing the "aggregate" by heating or the like. The "base particles" comprises a size that is substantially a diameter size of the toner to be obtained. The term "toner base particles" denotes particles at a stage preceding the obtaining of the final toner, i.e. base particles or base particles subjected to an appropriate surface treatment. The term "toner" denotes dried toner base particles or toner base particles having optionally an external additive, such as a hydrophobic inorganic dispersant, adhered to the surface of toner base particles.

(Toner Constituent Materials)

The toner obtained in the production method of the present teachings has the binder resin as the main component, and may comprise also the colorant, release agent, charge control agent and the like. More specifically, the toner comprises a core in the form of base particle. The toner obtained in accordance with the production method of the present teachings may have charge control resin microparticles on the surface of the base particles. Also, the toner obtained in accordance with the production method of the present teachings may have an external additive, such as a hydrophobic inorganic dispersant, adhered to the surface of the toner base particles.

(Binder Resin)

The binder resin, which is the main component of the toner, comprises a synthetic resin that becomes fixed (thermal fusion bonding) onto the surface of a recording medium (paper, an OHP sheet or the like) through heating and/or pressing. The binder resin is not particularly limited, and any known synthetic resin used as a binder resin for toner may be employed. Examples thereof include, for instance, polyester resins, styrene resins (styrene or derivatives thereof such as polystyrene, poly-p-chlorostyrene and polyvinyltoluene; styrene-styrene derivative copolymers such as styrene-p-chlorostyrene copolymers and styrene-vinyltoluene copolymers; and styrene copolymers such as styrene-vinylnaphthalene copolymers, styrene-acrylate copolymers, styrene-methacrylate copolymers, styrene-methyl α-chloromethacrylate copolymers, styrene-acrylonitrile copolymers, styrene-vinyl methyl ether copolymers, styrene-vinyl ethyl ether copolymers, styrene-vinyl methyl ketone copolymers, styrene-butadiene copolymers, styrene-isoprene copolymers, and styrene-acrylonitrile-indene copolymers); and other resins such as acrylic resins, methacrylic resins, polyvinyl chloride resins, phenolic resins, naturally modified phenolic resins, natural resin-modified maleic acid resins, polyvinyl acetate resins, silicone resins, polyurethane resins, polyamide resins, furan resins, epoxy resins, polyvinyl butyral resins, terpene resins, coumarone-indene resins, and petroleum resins. These resins can be used alone or in combination. Preferably, the binder resin has hydrophilic groups. A binder resin having hydrophilic groups allows obviating the need for including a surfactant during emulsion preparation. Examples of hydrophilic groups include, for instance, cationic groups such as quaternary ammonium groups, quaternary ammonium salt-containing groups, amino groups and phosphonium salt-containing groups; and anionic groups such as carboxyl groups and sulfonic acid groups.

The binder resin used in the present teachings includes preferably anionic groups. The presence of the anionic groups allows avoiding or curbing the use of surfactant during the below-described production of a base microparticle suspension. Examples of anionic groups include, for instance, carboxyl groups, sulfonic acid groups, phosphonic groups, sulfinic groups and the like. In terms of emulsifiability and storage stability, the anionic groups are preferably carboxyl groups.

Examples of the binder resin having anionic groups include, for instance, polyester resins. Other than at the termini, the polyester resin also may comprise carboxyl groups and/or other anionic groups within the structural units of the resin. Preferably, however, the polyester resin includes carboxyl groups, as anionic groups, at the termini of the molecule. More preferably, the polyester resin includes carboxyl groups, as anionic groups, only at the termini of the molecule, since the presence of carboxyl groups at the termini of the molecule has the effect of facilitating neutralization reactions and emulsion stabilization. The polyester resin used as the binder resin may be crystalline or non-crystalline. The polyester resin used, having carboxyl groups, is a commercially available polyester resin, having for instance an acid value of 0.5 to 40 mgKOH/g, preferably of 1.0 to 20 mgKOH/g, a weight-average molecular weight (as measured by GPC based on a calibration curve using standard polystyrene) of 9,000 to 200,000, preferably 20,000 to 150,000, and having a cross-linked fraction not higher than 10 wt % (THF insoluble fraction), preferably of 0.5 to 10 wt %. A lower acid value than the above ranges entails a smaller amount of reaction with a neutralizer, such as sodium hydroxide, that is added as a dispersion stabilizer. As a result, emulsification may be destabilized and a stable slurry may not be obtained. When, on the other hand, the acid value is higher than the above ranges, the toner is likelier to become excessively charged, which may give rise to problems such as reduced image density. When the weight-average molecular weight is lower than the above range, the mechanical strength of the toner may be insufficient, which can detract from the durability of the toner. By contrast, a weight-average molecular weight higher than the above ranges results in an excessively high melt viscosity in the toner and in large emulsion droplets, whereby coarse particles are likelier to form. Although the cross-linked fraction may be zero, a certain non-zero cross-linked fraction is nonetheless preferable with toner strength and fixabilty (in particular, high-temperature offset) in mind. For instance, the cross-linked fraction (THF insoluble fraction) is preferably no greater than 10 wt %, more preferably of 0.5 to 10 wt %. However, an excessively large cross-linked fraction may give rise to large emulsion droplets and coarse particles.

Polyester resins are superior in that they are transparent, are sufficiently colorless so as not to compromise toner image hue, have good compatibility with the above charge control resin as well as adequate fluidity when heated or under pressure, and can be made into microparticles. Polyester resins are also excellent in terms of charge stability and image quality. As resins on their own, polyester resins exhibit excellent strength and fixing performance.

To determine the molecular weight of the resin, the resin component is dissolved in THF to about 0.05 to 0.6 wt %, the insoluble component therein is filtered off with DISMIC (diameter 0.2 μm, made of PTFE, by Advantec). The THF solution fraction is thus collected and is measured in a GPC instrument, to calculate the molecular weight distribution on the basis of a calibration curve using five or more types of monodisperse polystyrene standard samples having a molecular weight of 100 to 10,000,000.

(Colorant)

The colorant, which imparts a desired color to the toner, is incorporated into the binder resin through dispersion or permeation. Carbon black may be used as the colorant. Other examples include, for instance, organic pigments such as Quinophthalone Yellow, Hansa Yellow, Isoindolinone Yellow, Benzidine Yellow, Perynone Orange, Perynone Red, Perylene Maroon, Rhodamine 6G Lake, Quinacridone Red, Rose Bengal, Copper Phthalocyanine Blue, Copper Phthalocyanine Green, or a diketopyrrolopyrole pigment; inorganic pigments and metal powders such as Titanium White, Titanium Yellow, ultramarine, Cobalt Blue, red iron oxide, aluminum powder, and bronze; oil-soluble dyes and dispersion dyes such as azo dyes, quinophthalone dyes, anthraquinone dyes, xanthene dyes, triphenylmethane dyes, phthalocyanine dyes, indophenol dyes, and indoaniline dyes; and rosin dyes such as rosin, rosin-modified phenol, and rosin-modified maleic acid resin. Other examples include dyes and pigments treated with higher fatty acids or resins. The foregoing can be used alone or in combinations corresponding to a desired color. In the case of monochromatic color toner, for instance, the colorant can be prepared by mixing a pigment and a dye of the same color, such as a rhodamine pigment and dye, a quinophthalone pigment and dye, or a phthalocyanine pigment and dye. The colorant is mixed at a ratio of, for example, 2 to 20 parts by weight, preferably 4 to 10 parts by weight, relative to 100 parts by weight of the binder resin.

(Release Agent)

The release agent is added in order to improve the fixability of the toner to the recording medium. In the case of heat and pressure fixing, a wax is ordinarily incorporated into the toner in such a manner that the toner can detach easily from a heating medium. Examples of the release agent include, for instance, ester waxes and hydrocarbon waxes. Examples of ester waxes include, for instance, aliphatic ester compounds, such as stearates, palmitates, as well as polyfunctional ester compounds such as pentaerythritol tetramyristate, pentaerythritol tetrapalmitate and dipentaerythritol hexapalmitate. Examples of hydrocarbon waxes include, for instance, polyolefin waxes such as low-molecular weight polyethylene, low-molecular weight polypropylene and low-molecular weight polybutylene; natural vegetable waxes such as candelilla wax, carnauba wax, rice wax, Japan wax (sumac wax) and Jojoba wax; petroleum waxes such as paraffin, microcrystalline and petrolatum, as well as modified waxes thereof; and synthetic waxes such as Fischer-Tropsch waxes. These waxes can be used alone or in combinations. Preferably, the wax is one of the above waxes having a melting point of 50 to 100° C. A wax having a low melting point and a low melt viscosity melts before melting of the binder resin and becomes smeared on the toner surface, even for a low heating temperature in the fixing device. As a result, offset can be prevented. More specifically, the wax is an ester wax or a paraffin wax. The wax is blended in a proportion of, for instance, 1 to 30 parts by weight, preferably 3 to 15 parts by weight relative to 100 parts by weight of the binder resin.

(Charge Control Agent)

The charge control agent is selected and used from a positively chargeable charge controller and/or a negatively chargeable charge controller, alone or in combination, depending on the intended purpose and the intended application. The charge control agent, which is not particularly limited, is imparted to the toner base particles mainly in one of the following ways, configurations of which may be combined: (1) the charge control agent being added beforehand into the toner base particles and/or (2) the charge control agent being adhered to the surface of the base toner particles.

Examples of the positively chargeable charge control agent used as in above (1) include, for instance, nigrosine dyes, quaternary ammonium compounds, onium compounds, triphenylmethane compounds, compounds containing basic groups, and acrylic resins containing tertiary amino groups. Likewise, examples of the negatively chargeable charge control agents include, for instance, trimethylethane dyes, azo pigments, copper phthalocyanine, salicylic acid metal complexes, benzylic acid metal complexes, perylene, quinacridone and metal-complex azo dyes.

Examples of the charge control agents used as in above (2) include, in addition to the charge control agents used as in (1) also, resin microparticles having a charge control resin as a main component (hereinafter referred to as charge control resin microparticles). In a state where the charge control agent is adhered to the surface of the toner base particles, the way in which adhesion is embodied is not particularly limited, and the charge control agent may be adhered to the surface of the toner base particles by virtue of some interaction, or at least part of the charge control agent may be adhered to the surface by being embedded thereinto, or may be adhered through fusion or the like. When the charge control resin microparticles are caused to adhere to the toner base particles, in a way in which adhesion thereof is embodied may be any of the above, but involves preferably embedding or fusion.

The charge control resin used has preferably polar groups. Using the charge control resin containing polar groups allows obtaining a well-dispersed charge control resin microparticle suspension, and allows the charge control resin microparticles to be fixed homogeneously to the base particles.

For example, in a negative charging toner, a styrene-acrylic copolymer may preferably used. Preferred styrene-acrylic copolymers are not particularly limited, but include, for instance, copolymers of styrene-based monomers such as styrene, o, m, p-chlorostyrene, α-methyl styrene, and alkyl (meth)acrylate monomers selected from alkyl acrylate such as (meth)acrylic acid, maleic acid, itaconic acid, methyl (meth)acrylate, ethyl(meth)acrylate, propyl(meth)acrylate, butyl(meth)acrylate, 2-ethylhexyl(meth)acrylate, amyl (meth)acrylate, cyclohexyl(meth)acrylate, lauryl(meth)acrylate, stearyl(meth)acrylate.

For example, in a positive charging toner, preferably polar groups such as quaternary ammonium groups, groups having a quaternary ammonium salt structure, amino groups, and groups having a phosphonium salt structure may suitably be used. In particular, groups having a salt structure are preferably used. Most preferably, the charge control resin used contains quaternary ammonium (salt) groups. Such groups having a salt structure allow obtaining a stable suspension, even when using no neutralizing agent or surfactants, or when using a limited amount thereof.

Examples of a charge control resin having quaternary ammonium groups include, for instance, a copolymer of a polymerizable component having a quaternary ammonium group, such as methacryloyl oxytrimethyl ammonium sulfate, with another copolymerizable component such as a vinyl-based monomer (cf. Japanese Patent Application Laid-open No. H8-220809). The copolymerizable component is not particularly limited, and any such component may be used so long as it has polymerizable unsaturated bonds.

The weight-average molecular weight (Mw) of the negative charge control resin is preferably set in the range of 3000 to 100000. When the molecular weight is less than 3,000, the charge control resin has poor strength, and toner particles aggregate readily. On the other hand, when the weight-average molecular weight exceeds 100,000, the charge control resin may become excessively hard, impairing fixability. The charge control resin may be cross-linked.

Preferably, the glass transition temperature (Tg) of the negative charge control resin is similar to or slightly higher than that of the toner base particles. For instance, when the Tg of the toner base particles is 60° C., the Tg of the charge control resin is preferably set to 60 to 65° C.

The amount of polar groups in the charge control resin can be appropriately adjusted on the basis of the copolymerization conditions. When using for instance a styrene-acrylic copolymer charge control resin, the amount of polar groups can be adjusted by varying the amount of acryl monomers that are copolymerized. The average particle size of the charge control resin microparticles varies depending on the average particle size of the toner to be obtained, but ranges preferably from about 50 to about 250 nm. The average particle size of the charge control resin microparticles can be determined by dynamic light scattering (laser Doppler), using a particle size analyzer Nanotrac™ UPA150 (manufactured by Nikkiso Co. LTD.). Specifically, the method set forth in the below examples may be utilized.

(External Additive)

Examples of an external additive include inorganic particles and synthetic resin particles. Examples of the inorganic particles that can be used include, for instance, silica, aluminum oxide, titanium oxide, silicon aluminum cooxide, silicon titanium cooxide, and hydrophobicized products thereof. Hydrophobization of a silica micropowder may involve, for instance, treating the silica micropowder with silicon oil or a silane coupling agent such as dichlorodimethylsilane, hexamethyldisilazane, tetramethyldisilazane or the like. Examples of synthetic resin particles include, for instance, methacrylate polymer particles, acrylate polymer particles, styrene-methacrylate copolymer particles, styrene-acrylate copolymer particles, and core-shell particles in which a shell of a methacrylate polymer is formed on a core of a styrene polymer. The addition amount of external additive is not particularly limited, and ranges ordinarily from 0.1 to 6 parts by weight relative to the toner base particles.

(Method for Producing Toner)

The method for producing the toner is explained hereinbelow. The method for producing the toner of the present teachings is an emulsification aggregation method that comprises, in particular, the following steps: (a) preparing the suspension of the above base microparticles; (b) producing the aggregate by aggregating the base microparticles in the base microparticle suspension; (c) producing the base particles by fusing the aggregate; and (d) producing the toner using the base particles. An explanation follows next, with reference to appropriate accompanying drawings, on a method for producing a toner by toner emulsification aggregation comprising the above steps.

Typically, the method for producing the toner of the present teachings comprises a resin solution preparation process S10, a base microparticle suspension preparation process S20, an aggregate production process S30, a base particle production process S40, a toner base particle production process S50 and a toner production process S60 (FIG. 1). The various processes S10 to S60 are explained in turn below.

(Resin Solution Preparation Process: S10)

In the resin solution preparation process S10, the binder resin, and usually a colorant, and optionally a release agent, are dissolved or dispersed in an organic solvent, as illustrated in FIG. 1. The binder resin is preferably dissolved in a neutralizer. When using a pigment as the colorant, the pigment is micro-dispersed, since it does not dissolve. Although the release agent is preferably dissolved as well, it need not necessarily be dissolved, and may be micro-dispersed instead. In the preparation of the resin solution, the resin solution may be appropriately heated at a temperature not higher than the boiling point of the organic solvent. Such heating is particularly preferred when a release agent is dissolved or dispersed.

Preferably, the organic solvent dissolves a wax at a temperature below the boiling point, but it is also desirable that the organic solvent should exhibit some water solubility in order to promote emulsification of the binder resin. In the production method of the present invention, it is particularly preferred to reduce the use of dispersants such as surfactants or the like for stabilizing an emulsion of the resin solution. It becomes then necessary to neutralize the hydrophilic groups of the binder resin. When using as a result a wholly hydrophobic solvent, the neutralization reaction does not advance, and emulsion stabilization becomes harder to accomplish. The solvent therefore has some water solubility. Preferably, such an organic solvent can exhibit a compatibility of 5 to 100% towards water at 25° C. Specific examples of the organic solvent include, for instance, esters such as ethyl acetate and butyl acetate; glycols such as ethylene glycol, diethylene glycol, ethylene glycol monomethyl ether and diethylene glycol monomethyl ether; ketones such as acetone, methyl ethyl ketone (MEK) and methyl isobutyl ketone; and ethers such as tetrahydrofuran (THF). These organic solvents can be used alone or in combination. Preferably, the organic solvent has a boiling point of 50 to 100° C., more preferably of 60 to 90° C. A specific example thereof is methyl ethyl ketone (boiling point: 79.6° C. at normal pressure (1 atm)) or tetrahydrofuran (boiling point: 65° C. at normal pressure). The organic solvent is blended in a proportion of, for instance, 100 to 2,000 parts by weight, preferably 200 to 1,000 parts by weight relative to 100 parts by weight of binder resin.

In the preparation of the resin solution, a colorant dispersion is preferably prepared beforehand by micro-dispersing the colorant in a solvent. The method for dispersing the colorant may involve, for instance, mixing the colorant, a solvent and a dispersant, and pre-dispersing the mixture in a disper, a homogenizer or the like, followed by micro-dispersion in a bead mill, a high-pressure homogenizer or the like. In order to prevent colorant aggregation when preparing beforehand a colorant dispersion, the colorant dispersion is preferably diluted slowly first, and is then mixed with the resin and/or release agent to dissolve/disperse the foregoing during the preparation of the resin solution.

When using a dye or the like that dissolves in the solvent, the colorant need not particularly be dispersed. A dispersant for pigment dispersion is preferably used in order to micro-disperse the pigment. For instance, a surfactant or a high-molecular weight dispersant can be used as the dispersant. The binder resin may also function as a dispersant, and hence the binder resin may also be used as the dispersant.

(Base Microparticle Suspension Preparation Process: S20)

In the base microparticle suspension preparation process S20, an emulsion is prepared next by mixing and emulsifying the resin solution and the aqueous medium, after which the organic solvent component is removed by evaporation, thereby to prepare a suspension in which the base microparticles are dispersed in the aqueous medium. The aqueous medium may be water, or a liquid mixture of water and an organic solvent compatible with water. Examples of the organic solvent include, for instance, an alcohol.

In the above process of the production method of the present teachings, the base microparticle suspension is preferably prepared by dispersing the base microparticles through neutralization of at least some of the anionic groups of the binder resin. More preferably, the base microparticle suspension is prepared without using a surfactant. Neutralization of the anionic groups has the effect of imparting hydrophilicity to the binder resin itself, thereby affording emulsion stabilization. As a result, the use of surfactant can be avoided, or the use amount of surfactant reduced, in the toner production process.

As the neutralizer of the anionic groups, e.g., various organic alkalis and inorganic alkalis can be used. The neutralizer used is preferably an alkaline aqueous solution. Examples of the aqueous alkaline solution include an aqueous organic base solution prepared by dissolving a basic organic compound such as an amine in water, and an aqueous inorganic base solution prepared by dissolving an alkaline metal such as sodium hydroxide or potassium hydroxide in water. The aqueous inorganic base solution is prepared as an aqueous sodium hydroxide solution or aqueous potassium hydroxide solution, e.g., of 0.1 to 5N (normal), preferably 0.2 to 2N (normal). If a wax poorly dissolvable in the resin solution is blended therein on account of water inclusion, then an aqueous organic base solution is preferably employed, in terms of preventing precipitation of the wax.

The neutralizer may be mixed into the aqueous solvent, or may be mixed with the resin solution. Alternatively, the neutralizer may be added after mixing of the resin solution and the aqueous solvent. Emulsification may be achieved by blending the resin solution into the aqueous solvent, or by blending the aqueous solvent into the resin solution. Emulsification can be carried out down to a much smaller toner particle size, of the order of 100 to 500 nm, through shear imparted in a homogenizer or the like. Stabilizing the emulsion in this state and then removing the solvent allows obtaining a suspension having dispersed therein the base microparticles at the nm level.

If the emulsion is stabilized, the organic solvent removing process can be performed. The suspension of base microparticles can thereby be obtained. To remove the organic solvent from the emulsion, a conventionally known method such as air-blowing, heating, vacuum, or a combination thereof may be employed. For instance, the emulsion is heated in an inert gas atmosphere, from room temperature to 90° C., preferably from 65 to 80° C., until about 80 to 95 wt % of the initial amount of the organic solvent is removed. As a result, the organic solvent is removed from the aqueous medium, thereby to prepare a suspension (slurry) in which resin microparticles of the binder resin having the colorant and wax uniformly dispersed thereon is dispersed in the aqueous medium. For instance, the volume average particle size of the base microparticles ranges preferably from about 50 nm to about 1000 nm. The volume average particle size smaller than 50 nm tends to require a greater amount of aggregating agent during aggregation. The volume average particle size in excess of 1000 nm makes it more difficult to achieve toner base particles having a sharp particle size distribution during aggregation.

The average particle size of the base microparticles can be determined by dynamic light scattering (laser Doppler), using a particle size analyzer Nanotrac™ UPA150 (by Nikkiso Co. LTD.). The specific method used may be the method set forth in the examples.

(Aggregate Production Process: S30)

In the aggregate production process S30, the base microparticles in the base microparticle suspension obtained in process S20 above are aggregated in the presence of a predetermined non-ionic surfactant, to yield a base microparticle aggregate. Prior to the aggregation, the solids concentration in the base microparticle suspension may be adjusted by diluting the base microparticle suspension with water, as the case may require. The solids concentration range, for instance, from 1 wt % to 30 wt %, preferably from 5 wt % to 20 wt %.

Preferably, the non-ionic surfactant is such that the surface tension of the aqueous solution thereof at any concentration at or above the critical micelle concentration is not smaller than 45 mN/m. A toner that combines both good particle size distribution and storage stability can be obtained when the aqueous solution of the non-ionic surfactant used in the aggregation production process exhibits such a surface tension. When the surface tension of the aqueous solution is equal to or greater than the above-mentioned numerical value, however, the Tg of the base particles and the toner drops, which impairs storage stability. The feature "any concentration at or above the critical micelle concentration" is not particularly limited, so long as the concentration lies at or above the critical micelle concentration. However, the concentration is preferably not lower than 0.1 wt %, more preferably of about 0.2 wt %.

The non-ionic surfactant is preferably used in the aggregation production process in a concentration such that the surface tension of aqueous solution thereof is not lower than the above-mentioned numerical value. The concentration of the surfactant in the aggregation production process is not particularly limited, so long as the resulting aqueous solution exhibits the above-mentioned surface tension. Ordinarily, the surface tension elicited by the surfactant becomes substantially stabilized at concentrations at or above the critical micelle concentration, but with a tendency to drop as the concentration increases gradually beyond the critical micelle concentration. Therefore, the concentration in which the non-ionic surfactant is used in the aggregate production process is preferably set in accordance with the critical micelle concentration. The concentration of non-ionic surfactant can be set, for instance, to 0.1 wt % or higher.

The surface tension can be measured, for instance, using the method described in the examples, or using other methods that yield the same measurement values as the method described in the examples. The precision and accuracy of these other methods are preferably similar to those of the method described in the examples.

Preferably, the non-ionic surfactant has a polyoxyalkylene chain. The alkylene groups in the polyoxyalkylene chain are preferably C1 to C4 lower alkylene groups, more preferably ethylene, propylene or isopropylene. The non-ionic surfactant may have two or more types of polyoxyalkylene chain, and may be a block copolymer. Examples of the non-ionic surfactant may include, for instance, a polyoxyalkylene glycol, a polyoxyalkylene decyl ether, a polyoxyalkylene isodecyl ether, a polyoxyalkylene tridecyl ether, a polyoxyalkylene lauryl ether, a polyoxyalkylene branched decyl ether, a polyoxyalkylene styrenated phenyl ether or the like.

More specific examples of the non-ionic surfactant may include, for instance, polyoxyethylene polyoxypropylene glycol, polyoxyethylene isodecyl ether, and polyoxyethylene styrenated phenyl ether. Preferred among the foregoing is polyoxyethylene polyoxypropylene glycol.

The weight-average molecular weight (as measured by GPC based on calibration curves of standard polystyrene) of the non-ionic surfactant that is used is not particularly limited, and the non-ionic surfactant may have a weight-average molecular weight ranging from about 200 to about 15,000.

Examples of polyoxyethylene polyoxypropylene block copolymers may include, for instance, Epan 485, Epan 680, Epan 785 and the like. Examples of polyoxyethylene isodecyl ether include, for instance, Noigen SD300 or the like (all by Dai-Ichi Kogyo Seiyaku Co. LTD.). Examples of polyoxyethylene styrenated phenyl ether include, for instance, Noigen EA167 (by Dai-Ichi Kogyo Seiyaku Co. LTD.) or the like.

In terms of particle size distribution and storage stability of the toner, the amount in which the non-ionic surfactant is used in the above process is not particularly limited, but the concentration of the non-ionic surfactant in the aqueous phase during aggregation ranges preferably from 0.005 wt % to 1 wt %. More preferably, the concentration ranges preferably from 0.05 wt % to 0.3 wt %, and yet more preferably from 0.1 wt % to 0.3 wt %, in terms of the surface tension stabilization elicited through the addition of the non-ionic surfactant. The amount of the non-ionic surfactant during aggregation ranges preferably from 0.015 parts by weight to 3 parts by weight, more preferably from 0.15 parts by weight to 1 part by weight, relative to 100 parts by weight of base microparticles (solids).

The non-ionic surfactant is added to the base microparticle suspension e.g., in the form of an aqueous solution of the non-ionic surfactant. The non-ionic surfactant aqueous solution may be added to the base microparticle suspension before or after the solids adjustment of the base microparticle suspension.

An aggregating agent for aggregation of the base microparticles may be added to the base microparticles suspension. Examples of the aggregating agent may include, e.g., inorganic metal salts such as calcium nitrate and magnesium chloride, polymers of inorganic metal salts such as polyaluminum chloride, and cationic surfactants. In the present teachings, an inorganic metal salt or a polymer thereof is preferably used, since these aggregating agents, typified by strongly acidic metal salts (preferably, salts of a strong acid and a weak base), have a strong base microparticle aggregation ability. In other words, such aggregating agents have a strong tendency to aggregate the above-described binder resins such as polyester resins, eliciting thus strong base microparticle aggregation ability.

For example, the aqueous solution of the aggregating agent adjusted e.g., to 0.01 to 1.0N (normal), preferably 0.05 to 0.5N (normal), is added, with stirring, at a ratio e.g., of 0.1 to 10 parts by weight, preferably 0.5 to 5 parts by weight relative to 100 parts by weight of the suspension. The stirring method is not particularly limited. For instance, the suspension is dispersed in a high-speed dispersing apparatus such as a homogenizer, after which mixing proceeds using a stirrer equipped with stirring blades, to completely fluidize the suspension thereby. As the mixing blade there is used a well-known blade such as a flat turbine blade, a propeller blade or an anchor blade. Stirring may also be carried out using an ultrasonic disperser. The liquid temperature during stirring is, for instance, 10 to 50° C., preferably 20 to 30° C., and the stirring time is for instance 5 to 60 minutes, preferably 10 to 30 minutes. Thereafter, the suspension is preferably heated, to homogenize the aggregated state. Heating is carried out for instance up to a temperature at which particles do not fuse. In terms of preventing formation of coarse particles, heating is carried out preferably at a liquid temperature lower than the Tg of the base microparticles. For instance, the suspension is heated at a temperature of 35 to 60° C., more preferably temperature of about 40 to about 45° C.

(Production Process of Base Particles: S40)

In this process, the base particles are prepared through fusion of the aggregate by heating. Aggregation of the base microparticles is terminated prior to fusion of the aggregate. Once the base microparticles have formed the aggregates of desired size, an aggregation terminator is preferably added to discontinue aggregation. The volume average particle size of the base particles ranges e.g., not less than about 6 μm to not more than about 10 μm. Examples of the aggregation terminator may include, an ionic surfactant of inverse polarity, or an alkaline metal in the form of sodium hydroxide or potassium hydroxide. Preferably, the aggregation terminator is an alkaline metal. When the base microparticles are dispersed through neutralization of the anionic groups in the binder resin, aggregation can be easily terminated in the aggregation system of the base microparticles through regulation of pH and ionic strength using an alkaline metal. Doing so allows limiting or avoiding the use of a surfactant. The problems derived from the addition of a non-ionic surfactant in the present teachings (for instance, the Tg drop in the toner base particles caused by surfactant use) can be minimized as a result. During aggregation discontinuation, for example, an alkaline metal aqueous solution adjusted for instance to 0.01 to 5.0 N (normal), preferably 0.1 to 2.0 N (normal), is added at a ratio of for instance 0.5 to 20 parts by weight, preferably 1.0 to 10 parts by weight, relative to 100 parts by weight of the suspension, under continued stirring. For instance, an aqueous solution of sodium hydroxide is added as the aggregation terminator.

Fusion of the aggregate, i.e. fusion between the base microparticles that composes the aggregate, is carried out through addition of the aggregation terminator and heating at a temperature at or above the Tg of the binder resin, under continued stirring. Heating is performed, for instance, from 55 to 100° C., preferably from 66 to 95° C. For instance, heating is performed up to a liquid temperature of 90° C. Preferably, heating is performed up to a temperature at least 20° C. higher, more preferably at least 30° C. higher than the Tg of the binder resin (the base microparticles).

The aggregate undergoes shape transformation when fusing. Once a desired shape is achieved, therefore, heating is stopped and is followed by cooling, under continued stirring, to bring the temperature down to a temperature preferably at least 10° C. lower, more preferably at least 20° C. lower than the Tg of the binder resin (base microparticles). Cooling may involve natural cooling, or rapid cooling using external cooling water or the like. A fused aggregate, i.e., the base particles, can be obtained as a result of the above process. The actual process yields a suspension containing the base particles.

(Production Process of Toner Base Particles: S50)

The toner base particles are produced by adjusting the charge characteristics of the base particles, as the case may require, by way of a charge control agent or by way of a charge control resin microparticles. A step of imparting charge characteristics to the surface of base particles is explained next. The toner base particle production process (S50) can be omitted.

The suspension containing base particles thus obtained is subjected to solid-liquid separation and washing, to adjust the suspension to appropriate solids concentration, aqueousness and so forth. The charge characteristics can be imparted to the base particles by way of a charge control agent, or by way of charge control resin microparticles. An explanation follows next on a step of causing the charge control resin microparticles to adhere to the base particles. Specifically, a base particle suspension and a charge control resin microparticle suspension are mixed, to cause the charge control resin microparticles to adhere to the surface of the base particles.

The charge control resin microparticle suspension can be prepared e.g., in the below-described processes. Firstly, the charge control resin is mixed with water and an organic solvent capable of dissolving or swelling the charge control resin, and the resulting mixture is emulsified in a high-speed stirrer such as the homogenizer. The suspension in which the charge control resin microparticles are dispersed in the aqueous medium can be obtained by removing the organic solvent component from the emulsion using a known method such as heating under reduced pressure. The average particle size of the charge control resin microparticles can range, for instance, from 50 nm to 250 nm. The charge control resin can be produced by solution polymerization, emulsion polymerization or soap-free emulsion polymerization.

Predetermined amounts of the base particle suspension and the charge control resin microparticle suspension are mixed together, and are stirred or the like in such a manner that the base particles and the charge control resin microparticles come into good contact with each other. Thereafter, the resulting mixture is heated under predetermined conditions, thereby to produce the toner base particles upon which the charge control resin microparticles are fixed to the surfaces thereof. Preferably, the charge control resin microparticles are fixed at a liquid temperature around the Tg of the base particles. For instance, if the Tg of the base particles is 55° C., then the charge control resin microparticles are preferably mixed and then heated and stirred at a temperature of 55° C. for 15 to 60 minutes. Due to the aforesaid processes, the toner base particles that comprises the charge control resin microparticles on the surfaces thereof are obtained in a form of the suspension including said particles.

In a case of treating the base particle surfaces with the charge control agent, the dispersion or solution of the charge control agent is e.g., mixed with the toner base particles, with stirring and optional heating, followed by filtering and drying, to fix thereby the charge control agent to the toner base particles.

(Toner Production Process: S60)

The toner base particles thus obtained as a result of the above operations are sufficiently charged. However, it is preferable to cause an external additive to adhere to the surfaces of the toner base particles, with a view to enhancing fluidity and storage stability in the toner. Preferably in particular, an inorganic oxide hydrophobized using a silane coupling agent or the like is externally added. After addition of the external additive, the toner base particles may be sorted with a sieve or the like to yield the final toner.

Upon adhesion of the external additive, the toner base particles are preferably recovered, for instance, by filtering the toner base particle suspension obtained in the toner base particle production process S40, and then washing and drying the toner base particles to a predetermined water content. Washing is carried out by replacing at least part of the toner base particle suspension with a low-conductivity medium such as water. This can be accomplished, specifically, by performing solid-liquid separation on the toner base particle suspension and by re-suspending solid content in water or the like, for an appropriate number of times. For instance, drying is performed preferably down to a water content not higher than 1 wt %. The drying method is not particularly limited, and ordinary methods may be employed. Drying may be accomplished, for instance, by fluidized bed drying or air stream drying (Flash Jet Dryer, by Seishin Enterprise Co., LTD.).

In the above-described aggregate production process (S30) of the method for producing the toner of the present teachings, the non-ionic surfactant is used such that the aqueous solution thereof has the surface tension not lower than the predetermined numerical value. Drops in the ultimately obtained Tg are curbed as a result, so that good particle size distribution and storage stability can be achieved simultaneously. As regards to Tg, in particular, the Tg drop in the toner can be limited to no more than 2° C. below the Tg of the binder resin itself. This allows enhancing the storage stability of the toner (typically, the increase in the degree of agglomeration in high-temperature environments can be limited to no more than 5%, as shown in the examples).

The toner obtainable in accordance with the production method of the present teachings can be preferably used as a non-magnetic mono-component toner (i.e. single component developer), but can also be used as a two-component toner, e.g., by being blended with a suitable carrier. As the carrier there can be used glass beads, steel shot or the like coated with a resin, in the case of cascade developing, or ferrite, iron dust or so-called binder-type carriers in the case of magnetic brush developing.

The toner obtainable in accordance with the production method of the present teachings can be used as toner in electrophotographic and electrostatic-recording image forming apparatuses such as all manner of monochrome/color laser printers, fax machines, copiers and multifunction machines.

EXAMPLES

The present teachings will be explained in more detail next on the basis of specific examples. The teachings disclosed herein, however, are not limited to or by the examples below. In the examples, "parts" denote "parts by weight" and "%" denotes weight percent.

The measurement method used in the below-described examples will be explained first.

(1) Glass Transition Temperature (DSC)

Glass transition temperature was measured using a differential scanning calorimeter (DSC6220; by SII NanoTechnology Inc.). About 5 mg of sample were placed in a dedicated aluminum crucible that was heated from −10° C. to 170° C. at a temperature rise rate of 10° C./min (1st run). The heated sample was then cooled to −10° C. at a rate of 10° C./min, and was heated again from −10° C. to 170° C. at a rate of 10° C./min (2nd run). As a reference, 9.7 mg aluminum plate was placed in the same aluminum crucible. The glass transition temperature Tg in the examples below refers to the median glass transition temperature in the 2nd run.

(2) Molecular Weight

The resin component was dissolved in THF, the insoluble fraction was filtered off using DISMIC (diameter 0.2 μm, made of PTFE, by ADVANTEC Ltd.), and the THF solution was collected. The THF solution was measured using a GPC instrument, to calculate the molecular weight distribution in terms of standard polystyrene.

(3) Particle Size Measurement Method (Size of the Base Microparticles Particle and Charge Control Resin Microparticles)

The instrument used was Nanotrac UPA150, by Nikkiso Co., LTD. The base microparticles containing carbon were measured under a solvent refractive index of 1.33 (water) and a particle refractive index of 1.91. The charge control resin microparticles not containing carbon were measured under a particle refractive index of 1.51. A sample suspension in which the microparticles were dispersed was adjusted to a suitable concentration falling within a concentration range that is appropriate for the measurement conditions in the measurement unit of the instrument. The sample was dripped using a dropper, and was measured thrice over a measurement time of 60 seconds. The median particle size was taken as the average size.

(Size of the Base Particles)

The size of the base particles was measured using a Coulter Multisizer III (by Beckman Coulter, Inc.), to an aperture diameter of 100 μm, as the measurement instrument. Specifically, 0.2 g of base particles were dripped into and mixed with 50 cc of a 0.1% aqueous solution of a dispersant (Pelex OT-P, by Kao Corp.) in distilled water, to prepare a suspension, using ultrasonic dispersion or the like as needed. Then, three to five drops of the suspension were dripped, using a 2 ml dropper, into the above measurement instrument, where about 50,000 particles were measured. The ratio Dv/Dn of the obtained volume reference average particle size Dv and the number reference average particle size Dn was taken as an index that denoted the sharpness of the particle size distribution.

(4) Nonvolatile Component (Solids) in the Suspension

The nonvolatile component amount in the suspension was calculated by measuring the total liquid amount, sampling 2 to 20 g thereof into an aluminum container, and placing the container in a dryer at 50° C., to dry the sample by evaporation. Samples of 2 g were taken from the base particle suspension and the charge control resin microparticle suspension. The nonvolatile component concentration can be estimated beforehand. Thus, about 20 g were sampled and vaporized from liquids with abundant nonvolatile component (for instance, the base microparticle suspension), or with little nonvolatile component (for instance, nonvolatile component in the filtrate).

(5) Surface Tension

The measurement instrument used was a FACE Automatic Surface Tensiometer CBVP-Z by Kyowa Interface Science Co., LTD. A 0.2% surfactant aqueous solution was prepared. The surfactant aqueous solution was poured to about half the height of a glass Petri dish (diameter about 50 mm, height about 20 mm). All bubbles present on the liquid surface were removed using a dropper. The Petri dish was placed on the specimen stage of the measurement instrument. Meanwhile, a platinum plate (23.85 mm wide, 0.16 mm thick and 10 mm high) was red-heated using an alcohol lamp, to remove impurities on the plate. The platinum plate was locked onto a detection hook of the measurement instrument, and was left to cool naturally for about 3 minutes. The measurements began in a state where the surroundings of the measurement portion were screened, to avoid the influence of wind or the like. The automatic measurement instrument detected and calculated the force exerted on the platinum plate by the surfactant aqueous solution that wetted the platinum plate, by way of the detection hook. The above measurement operation was repeated three times, and the average value was taken as measurement data. The measurements were carried out at room temperature (25° C.). The liquid temperature during the measurements was 25±1° C.

Example 1

In the examples there were produced base particle suspensions 1 to 7, as well as base particle suspensions 1 to 4 in of comparative examples, using the respective non-ionic surfactants given in FIG. 2 during aggregate production. The volume particle size distribution of the respective base particles was measured. A charge control resin suspension was mixed with the respective base particle suspensions to produce toners 1 to 7 and comparative examples 1 to 4. The toners were measured for Tg and particle size distribution (particle size distribution measured in the base particles). The results are summarized in FIG. 2.

(Preparation of a Base Particle Suspension A)

A mixture comprising 15 parts of a polyester resin FC1565 (Tg: 62° C.; Mn 4500; Mw 70000; gel fraction 0.8 wt %; acid value 6.0 mgKOH/g; by Mitsubishi Rayon Co., LTD.), 15 parts of carbon black #260 (by Mitsubishi Chemical Corp.) and 70 parts of MEK, was pre-dispersed for 10 minutes at 10000 rpm in a homogenizer (Silent Crusher M, Shaft 18F, by Heidolph Instruments GmbH & Co. KG). Thereafter, 100 parts of this colorant dispersion and 450 parts of 1 mm-diameter zirconia beads were charged into a bead mill (RMB-04, by Imex Co., LTD.), where dispersion was carried out for 60 minutes at a stirring speed of 2000 rpm. The resulting colorant dispersion was recovered; then 60 parts of the colorant dispersion were mixed slowly with 690 parts of MEK, after which further 153 parts of FC 1565 and 9 parts of Paraffin Wax HNP-9 (by Nippon Seiro Co. LTD.) were mixed in under stirring. The whole was heated under stirring at a liquid temperature of 70° C., to prepare a resin solution.

Next, 900 parts of the resin solution, 900 parts of distilled water heated at 50° C. and 9 parts of a 1N sodium hydroxide aqueous solution were mixed and emulsified in a homogenizer (Shaft 22F) for 20 minutes at 15000 rpm. The obtained emulsion was transferred to a 2 L separable flask, where MEK was removed by heating under stirring for 140 minutes at 75° C. while blowing nitrogen into the gas phase, to yield a base microparticles suspension. The average size of the base microparticles was 295 nm, as a median size. The Tg of the base microparticles, measured by DSC, was 61° C.

(Preparation of a Base Particle Suspension 1)

The base microparticle suspension A was mixed with 57.6 g of a 5% aqueous solution of a non-ionic surfactant Epan 485 (by Dai-Ichi Kogyo Seiyaku Co., LTD.) (polyoxyethylene polyoxypropylene block copolymer; molecular weight about 8000), followed by dilution with distilled water, to yield 1600 g of a base microparticle suspension having 10% solids. To the suspension there were added 35 g of a 0.2N aluminum chloride aqueous solution, as an aggregating agent. The whole was mixed and stirred for 10 minutes in a homogenizer at 8000 rpm (the solution contained 0.2% of Epan 785), and was then heated at a liquid temperature of 44° C., while being stirred at 300 rpm with six flat turbine blades (diameter: 75 mm), to aggregate thereby the base microparticles.

This was followed by addition of 46 g of a 0.2N sodium hydroxide aqueous solution, as an aggregation terminator. The resulting mixture was then heated to a liquid temperature of 90° C. and was stirred for about 6 hours. The obtained base particles had a volume average particle size Dv of 7.1 μm, and a Dv/Dn of 1.17, which was indicative of a sharp particle size distribution (FIG. 2).

(Preparation of Base Particle Suspensions 2 to 7 and Comparative-Example Base Particle Suspensions 1 to 4)

Base particle suspensions 2 to 7 and comparative-example base particle suspensions 1 to 4 were prepared in the same way as the base particle suspension 1, except that herein the base microparticle suspensions were prepared using the various non-ionic surfactants given in FIG. 2, to concentrations of non-ionic surfactant in the base microparticle suspension, upon addition of the aggregating agent, as given in FIG. 2, and except those in toners 2 and 3, in particular, the amounts of aggregating agent and of aggregation terminator used were as described below. The volume particle size distribution of the obtained base particles was measured for all the base particle suspensions. The results are summarized in FIG. 2.

Toner 2: aggregating agent amount 50 g, terminator amount 60 g.

Toner 3: aggregating agent amount 30 g, terminator amount 60 g.

The non-ionic surfactants used were as follows (all by Dai-Ichi Kogyo Seiyaku Co., LTD.).

Toner 2: Epan 680 (polyoxyethylene polyoxypropylene block copolymer; molecular weight about 8750)

Toner 3: Epan 785 (polyoxyethylene polyoxypropylene block copolymer; molecular weight about 13333)

Toner 4: Noigen SD300 (polyoxyethylene isodecyl ether)

Toners 6, 7: Epan 785

Comparative example 1: Noigen TDX120D (polyoxyalkylene tridecyl ether)

Comparative example 2: Noigen XL100 (polyoxyalkylene branched decyl ether)

Comparative example 3: Noigen SD80 (polyoxyethylene isodecyl ether)

Comparative example 4: DKSNL250 (polyoxyethylene lauryl ether)

(Method for Producing a Charge Control Resin A)

A 1 L separable flask was charged with 225 parts of styrene monomers, 15 parts of an acrylic monomer (dimethylaminoethyl methacrylate methyl chloride quaternary salt (Acryl ester DMC, by Mitsubishi Rayon Co., LTD.)), 30 parts of butyl acrylate, 5 parts of an azo-based polymerization initiator (V65, by Wako Pure Chemical Industries, Ltd.), and 250 parts of MEK. The mixture was then bubbled for 30 minutes by blowing in nitrogen gas at a flow rate of 50 ml/min, and was then heated at a liquid temperature of 70° C. while blowing nitrogen into the gas-phase at a flow rate of 30 ml/min. The mixture was polymerized over about 10 hours under stirring at 150 rpm using six flat turbine blades. After the polymerization reaction, the reaction product was placed in a vacuum heating oven to remove the MEK solvent and yield a charge control resin. The resin had a Tg of 66° C. and an Mw of 13000.

(Preparation of a Charge Control Resin Microparticle Suspension A)

A mixture of 160 parts of the obtained charge control resin A, 740 parts of MEK and 900 parts of distilled water was emulsified in a homogenizer under stirring for 20 minutes at 16,000 rpm. Thereafter, MEK was evaporated off through heating under reduced pressure at a liquid temperature of 60° C. The microparticles in the obtained charge control resin microparticle suspension had an average size of 110 nm. The nonvolatile component in the suspension was 19.9 wt %.

(Production of toners 1 to 7 and comparative examples 1 to 4).

(Fixing of the Charge Control Agent A)

Herein, 1600 g of each base particle suspension was filtered and rinsed once, and the filtered particles were dispersed again in distilled water, to yield 1600 g of a suspension. Then, 1.0 part of the charge control resin microparticle suspension A was mixed with 1600 parts of the above suspension, under stirring at 170 rpm for 30 minutes, using six flat turbine blades, at a liquid temperature of 55° C. Thereafter, the resulting suspension was vacuum-filtered and was rinsed with 1000 parts of distilled water to yield a toner base particle cake containing 43% of water. Toner base particles having a water content lower than 1 wt % were obtained by drying the above toner base particle cake in a drier (temperature in the drier 50° C.) for 24 hours or longer.

External addition was carried out next by blending 100 parts of the toner with 1 part of hydrophobic silica HVK2150 (by Clariant Japan Co., LTD.) and 1.5 parts of NA50H (by Nippon Aerosil Co., LTD.), and by stirring the blend for 3 minutes at 2,500 rpm in a Mechanomill (by Okada Seiko Co., LTD.). After external addition, coarse silica aggregates were removed from the toner using a sieve, to yield a non-magnetic single-component positively chargeable toner. The Tg of the obtained toners was measured. The results are given in FIG. 2. FIG. 2 sets forth the drop (° C.) from the Tg (61° C.) of the base microparticles.

Example 2

Figure 3:
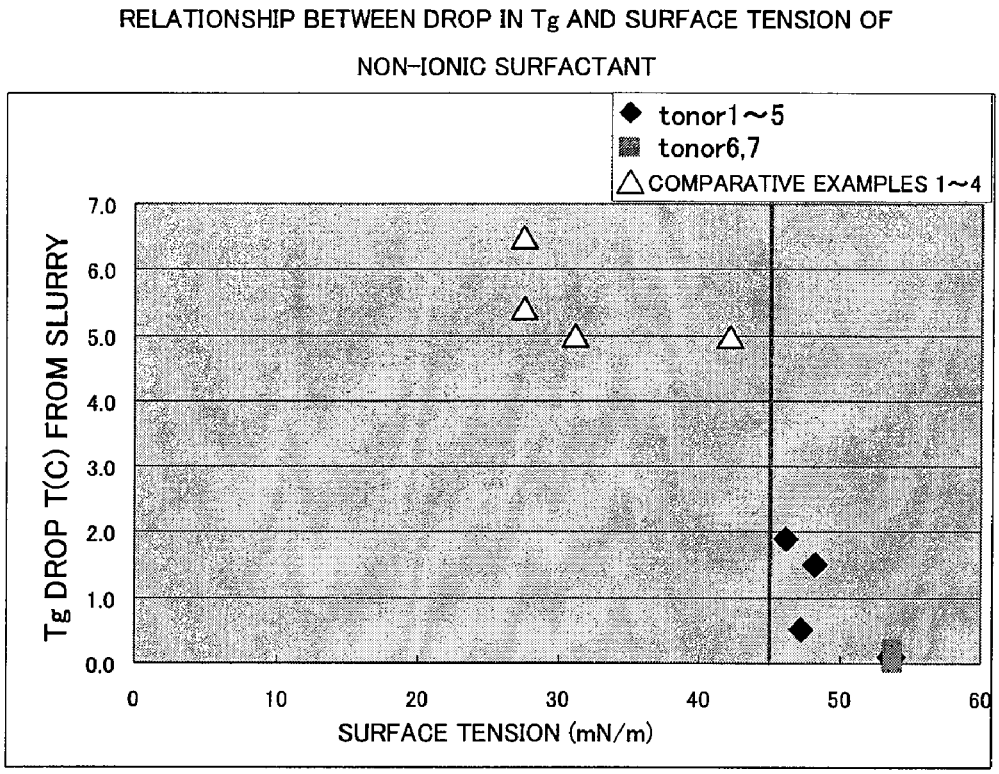
FIG. 3 is a graph illustrating the relationship between the drop in Tg and the non-ionic surfactant used during aggregation.

In the present example there was evaluated the storage stability of the toners 1 to 7 produced in Example 1, and of Comparative examples 1 to 4, in accordance with the method below. The surface tension of the aqueous solution of the non-ionic surfactants used to produce the aggregate was measured, at the concentrations given in FIG. 2, during production of each toner. The results are given in FIG. 2. FIG. 3 illustrates the relationship between the degree of Tg drop and the surface tension of the respective non-ionic surfactants used. The concentrations given in FIG. 2 of the non-ionic surfactants of FIG. 2 were all at or above the critical micelle concentration.

(Production of Storage Samples)

A sealed vessel (ϕ75 mm×75 mm×H90 mm) was charged with 10 g of a toner sample that was spread uniformly to avoid skewed filling. The toner sample was placed in a 55° C., 80% thermostatic tank, where it was left to stand for 36 hours. After the lapse of 36 hours, the toner was removed from the thermostatic tank, and was left to cool naturally for 1 hour at room temperature (about 25° C.).

(Measurement of the Degree of Agglomeration)

Degree of agglomeration was measured using a Powder tester (type PT-E), by Hosokawa Micron Co., LTD. Three metallic sieves having each a diameter of 80 mm were set up in the measurement apparatus. The sieves were fixed stacked onto each other in descending order of coarseness, namely 250 μm mesh, 150 μm mesh, and 75 μm mesh, from the top down. Toner samples, in an amount of 5 g each, were placed gently on the 250 μm mesh sieve. The apparatus was then caused to vibrate for 30 seconds at a vibration amplitude of 1 mm. Vibration was discontinued, and the weight of the toner sample retained at each sieve was measured. The degree of agglomeration of the toner was calculated based on the formula below. The difference resulting from subtracting the toner degree of agglomeration before exposure to high-temperature high-humidity conditions from the degree of agglomeration after exposure to high-temperature high-humidity conditions was acceptable when no greater than 5(%).

Degree of agglomeration (%)=(W250/Wt+W150/Wt×3/5+W75/Wt×1/5)×100, wherein

Wt: total sample weight (g)

W250: weight on 250 μm mesh (g)

W150: weight on 150 μm mesh (g)

W75: weight on 75 μm mesh (g)

Although the non-ionic surfactants used in toners 1 to 7 and comparative examples 1 to 4 had all polyoxyalkylene chains, the toners 1 to 7 in the Example, where aggregates were produced using non-ionic surfactants such that the surface tension of an aqueous solution of the surfactant at the concentrations given in FIG. 2 was 45 mN/m or higher, exhibited all a good (sharp) particle size distribution, while the drop in Tg of the base microparticles was kept no greater than about 2° C., as illustrated in FIGS. 2 and 3. Moreover, the toners did not exhibit a tendency to agglomerate at high temperature.

By contrast, in comparative examples 1 to 4, where non-ionic surfactants were used for which the surface tension was lower than 45 mN/m, the Tg drop was 5° C. or greater and storage stability was poor, despite the fact that particle size distribution was good.

The above results indicate that good storage stability and particle size distribution can be achieved simultaneously by using a binder resin (polyester resin) having anionic groups, and by using, during aggregation, a non-ionic surfactant such that the surface tension of an aqueous solution thereof is not lower than 45 mN/m at any concentration at or above the critical micelle concentration, when controlling the aggregation of base microparticles and the dispersion of the aggregate through neutralization of the anionic groups.

What is claimed is:

1. A method for producing a toner by aggregating and fusing base microparticles whose main component is a binder resin including anionic groups, the method comprising the steps of:

(a) preparing a resin solution by dissolving the binder resin in an organic solvent, and preparing an emulsion by emulsifying the resin solution in a presence of an aqueous medium;

(b) preparing a base microparticle suspension in which the base microparticles, having a volume average particle size in a range of about 50 nm to about 1000 nm, are dispersed in the aqueous medium by removing the organic solvent from the emulsion;

(c) aggregating said base microparticles in said base microparticle suspension, by stirring the base microparticle suspension at a liquid temperature of 10° C. to 50° C. in a presence of a non-ionic surfactant such that a surface tension of an aqueous solution thereof is not lower than 45 mN/m at any concentration at or above a critical micelle concentration;

(d) obtaining an aggregate of the base microparticles by adding an aggregation terminator to the base microparticle suspension so as to terminate the aggregation;

(e) producing base particles by fusing said aggregate; and (f) producing a toner using said base particles.

2. The production method according to claim 1, wherein said non-ionic surfactant includes a polyoxyalkylene chain.

3. The production method according to claim 1, wherein said non-ionic surfactant is used in a concentration ranging from 0.1 wt % to 0.3 wt % in said step (c).

4. The production method according to claim 1, wherein said step (a) is a step of preparing said emulsion of said base microparticles by dispersing said base microparticles through neutralization of at least some of said anionic groups.

5. The production method according to claim 4, wherein said step (a) is a step of preparing said emulsion of said base microparticles by dispersing said base microparticles without using a surfactant.

6. The production method according to claim 1, wherein said binder resin is a polyester resin.

7. The production method according to claim 1, wherein said aggregation terminator is sodium hydroxide.

* * * * *